US011246389B2

(12) United States Patent
Adelman et al.

(10) Patent No.: US 11,246,389 B2
(45) Date of Patent: Feb. 15, 2022

(54) SYSTEMS AND METHODS FOR A DEVICE MOUNTED CARD HOLDER AND WALLET

(71) Applicant: NITE IZE, INC., Boulder, CO (US)

(72) Inventors: Gregory M. Adelman, Boulder, CO (US); William R. Brennan, Jr., Longmont, CO (US)

( * ) Notice: Subject to any disclaimer, the term of this patent is extended or adjusted under 35 U.S.C. 154(b) by 619 days.

(21) Appl. No.: 16/183,513

(22) Filed: Nov. 7, 2018

(65) Prior Publication Data

US 2020/0138157 A1 May 7, 2020

(51) Int. Cl.
*A45C 11/18* (2006.01)
*A45C 11/00* (2006.01)

(52) U.S. Cl.
CPC ..... *A45C 11/182* (2013.01); *A45C 2011/002* (2013.01)

(58) Field of Classification Search
CPC ..... A45C 11/182; A45C 2011/002
See application file for complete search history.

(56) References Cited

U.S. PATENT DOCUMENTS 865,886 A * 9/1907 Guinn ..... G09F 3/20 40/649
1,970,621 A * 8/1934 Peterson ..... B42F 13/12 402/3
2,145,296 A * 1/1939 Draper ..... A44C 3/001 40/1.5
4,736,539 A * 4/1988 Dickinson ..... B60R 11/00 40/591
5,020,255 A * 6/1991 Rodel ..... A45C 11/182 206/37.1
5,718,329 A * 2/1998 Ippolito ..... A45C 11/182 150/147
5,938,010 A * 8/1999 Osterbye ..... A45C 11/182 206/38
6,026,873 A * 2/2000 Van Geer ..... A45C 11/182 150/147
2008/0163964 A1* 7/2008 Brannon ..... A45C 11/182 150/147
2013/0334070 A1* 12/2013 Adelman ..... A45F 5/00 206/37

* cited by examiner

*Primary Examiner* — Tri M Mai
(74) *Attorney, Agent, or Firm* — Haynes and Boone, LLP

(57) ABSTRACT

A mobile device mounted holder includes a body portion, the body portion including a slot for receiving cards. The mobile device mounted holder further includes an attachment mechanism, integrated with the body portion, for attaching to a mobile device. The mobile device mounted holder further includes a clip end located proximate to the slot, such that the clip end prevents the cards, when located in the slot, from sliding out of the slot and the clip end is attached to a flexible arm such that the clip end has a flexed position and in the flexed position the cards are removable.

21 Claims, 6 Drawing Sheets

SYSTEMS AND METHODS FOR A DEVICE MOUNTED CARD HOLDER AND WALLET

BACKGROUND

Consumers are increasingly focused on their smartphones and constantly have them with them. Smartphones have become more important than a user's wallet in many scenarios. Users may be less likely to forget their smartphone than their wallet. Despite this, a wallet is necessary in many scenarios. Therefore, there is a desire to combine the functions of a wallet in a streamlined format with a user's smartphone.

BRIEF SUMMARY

In one embodiment, a mobile device mounted holder includes a body portion, the body portion including a slot for receiving cards. The mobile device mounted holder further includes an attachment mechanism, integrated with the body portion, for attaching to a mobile device. The mobile device mounted holder further includes a clip end located proximate to the slot, such that the clip end prevents the cards, when located in the slot, from sliding out of the slot and the clip end is attached to a flexible arm such that the clip end has a flexed position and in the flexed position the cards are removable. In one alternative, the arm is formed by a first and second break in the body portion. Alternatively, the clip end includes a ramped portion. In another alternative, the body portion includes a lip. Optionally, the lip and the ramped portion cooperate to direct a card edge pressed against the ramped portion to an intersection point and at the intersection point the card edge will push against the ramped portion, causing the clip end to flex away from the lip and allow the insertion of the card edge. Alternatively, the lip is ramped in a direction opposite the ramped portion such that the lip and the ramped portion form a v-shape. In another alternative, the slot is sized to receive a standard credit card. Alternatively, the body portion includes aperture located distal from the clip end allowing access to the cards located in the slot. In one configuration, the attachment mechanism is adhesive. Optionally, the attachment mechanism is a case. Alternatively, the clip end includes a depression for receiving a finger of a user. In another alternative, the arm flexes along a length of the arm when the clip end is in the flexed position, the length of the arm stretching from the clip end to an interconnection point of the arm and the body portion. Optionally, the body portion includes a cutaway portion proximate to the clip end, providing access to the cards in the slot. Alternatively, the clip end and the attachment mechanism are on opposite sides of the body portion. In another alternative, the body portion is formed of a first body piece and a second body piece. Optionally, the first body piece is a plate on which the attachment mechanism is attached. Alternatively, the second body piece is a plate with three edges extending perpendicularly from the plate and the second body piece includes the arm.

In one embodiment, a mobile device mounted holder includes a body portion, the body portion including a slot for receiving cards. The mobile device mounted holder further includes an attachment mechanism, integrated with the body portion, for attaching to a mobile device. The mobile device mounted holder further includes a clip end located proximate to the slot, such that the clip end prevents the cards, when located in the slot, from sliding out of the slot and the clip end is attached to a flexible arm such that the clip end has a flexed position and in the flexed position the cards are removable. The clip end includes a ramped portion and the body portion includes a lip. The lip and the ramped portion cooperate to direct a card edge pressed against the ramped portion to an intersection point and at the intersection point the card edge will push against the ramped portion, causing the clip end to flex away from the lip and allow the insertion of the card edge. In one alternative, the lip is ramped in a direction opposite the ramped portion such that the lip and the ramped portion form a V-shape.

In one embodiment, a method of using a mobile device mounted holder includes providing a mobile device mounted holder. The mobile device mounted holder includes a body portion, the body portion including a slot for receiving cards. The mobile device mounted holder further includes an attachment mechanism, integrated with the body portion, for attaching to a mobile device. The mobile device mounted holder further includes a clip end located proximate to the slot, such that the clip end prevents the cards, when located in the slot, from sliding out of the slot and the clip end is attached to a flexible arm such that the clip end has a flexed position and in the flexed position the cards are removable. The clip end includes a ramped portion and the body portion includes a lip. The method further includes attaching the mobile device mounted holder to a mobile device using the attachment mechanism. The method further includes inserting a card by pressing the card into the ramped portion and the lip such that the lip and the ramped portion cooperate to direct the card to an intersection point and flex the clip end away from the lip and allow the insertion of the card. Alternatively, the method includes pressing the clip end away from the lip; and removing the card.

DETAILED DESCRIPTION

Certain terminology is used herein for convenience only and is not to be taken as a limitation on the embodiments of the systems and methods for a device mounted card holder and wallet. Generally, device mounted holders are designed to provide for a slot for the holding of credit cards, identification cards, or other slim insertable objects. Additionally, device mounted holders typically include some type attachment mechanism for attaching to the back of a smartphone, case, or other device. In many embodiments, the attachment mechanism is an adhesive. In many embodiments, the device further includes system for holding the cards in the slot. In many configurations, the system includes a lip or clip end attached to a flexible arm. The flexible arm may be flexed to release cards or other items in the slot.

Figure 1:
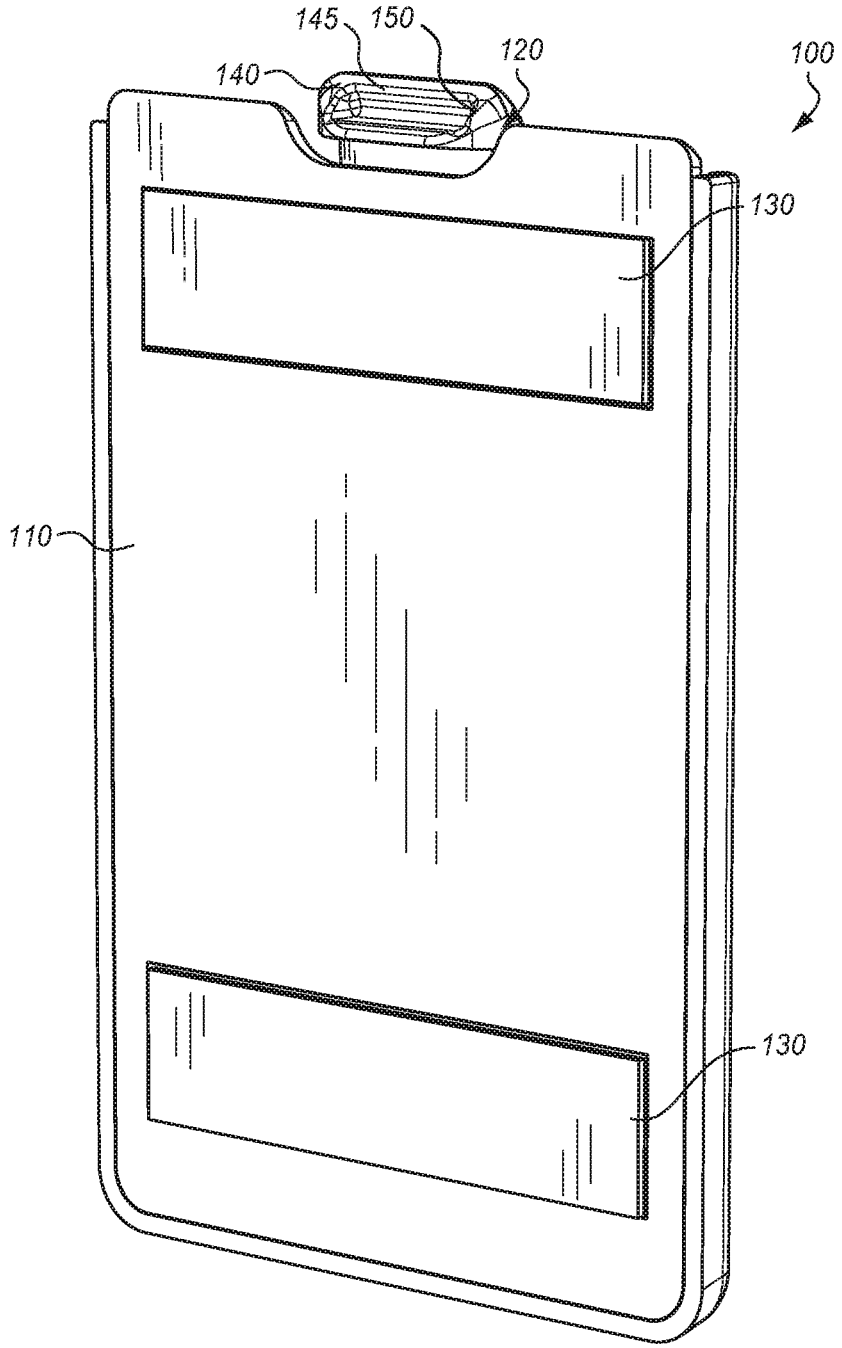
FIG. 1 shows a front perspective view one embodiment of a device mounted card holder and wallet.

FIG. 1 shows one embodiment of a device mounted holder 100. Device mounted holder 100 includes a body section 110. Body section 110 includes a slot 120 that is sized to receive cards or other items. Mounted on body section 110 are two adhesive sections 130. Typically, these adhesive section 130 include a removable cover for protection of the adhesive until application to a mobile device, such as a smartphone. Also visible is clip end 140. Clip end 140 is spring loaded via a flexible arm portion. Clip end 140 holds cards in place in the slot 120. Clip end 140 includes an approximately finger nail sized depression 145 for receiving the finger or finger nail of a user in order to flex back the clip end 140. Additionally, clip end 140 includes a ramped portion 150 that assists in inserting cards to slot 120. Based on this ramped portion 150, cards pressed against it will naturally depress and flex the clip end 140 back.

Figure 2:
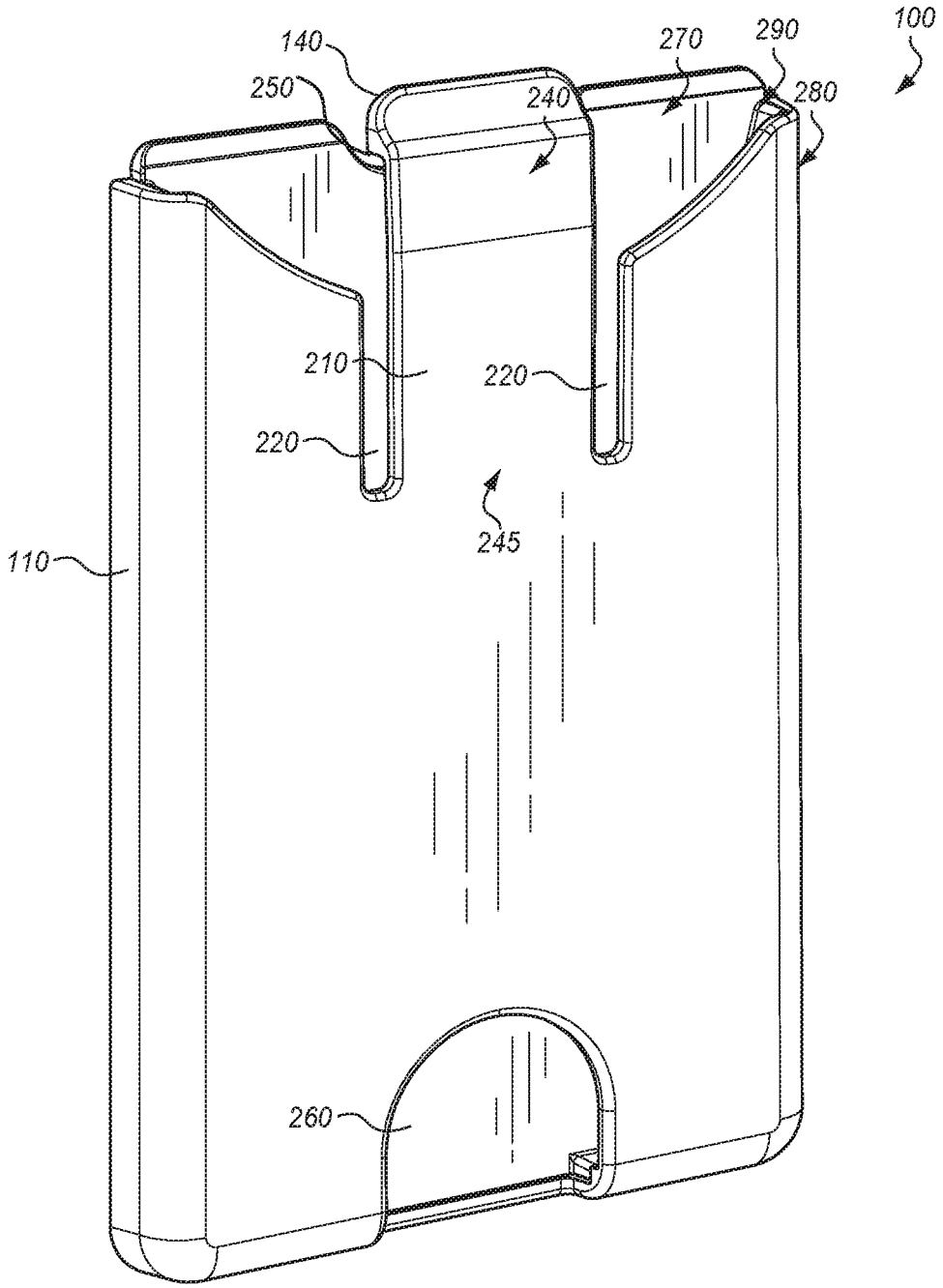
FIG. 2 shows a rear perspective view of the device mounted card holder and wallet of FIG. 1.
Figure 3:
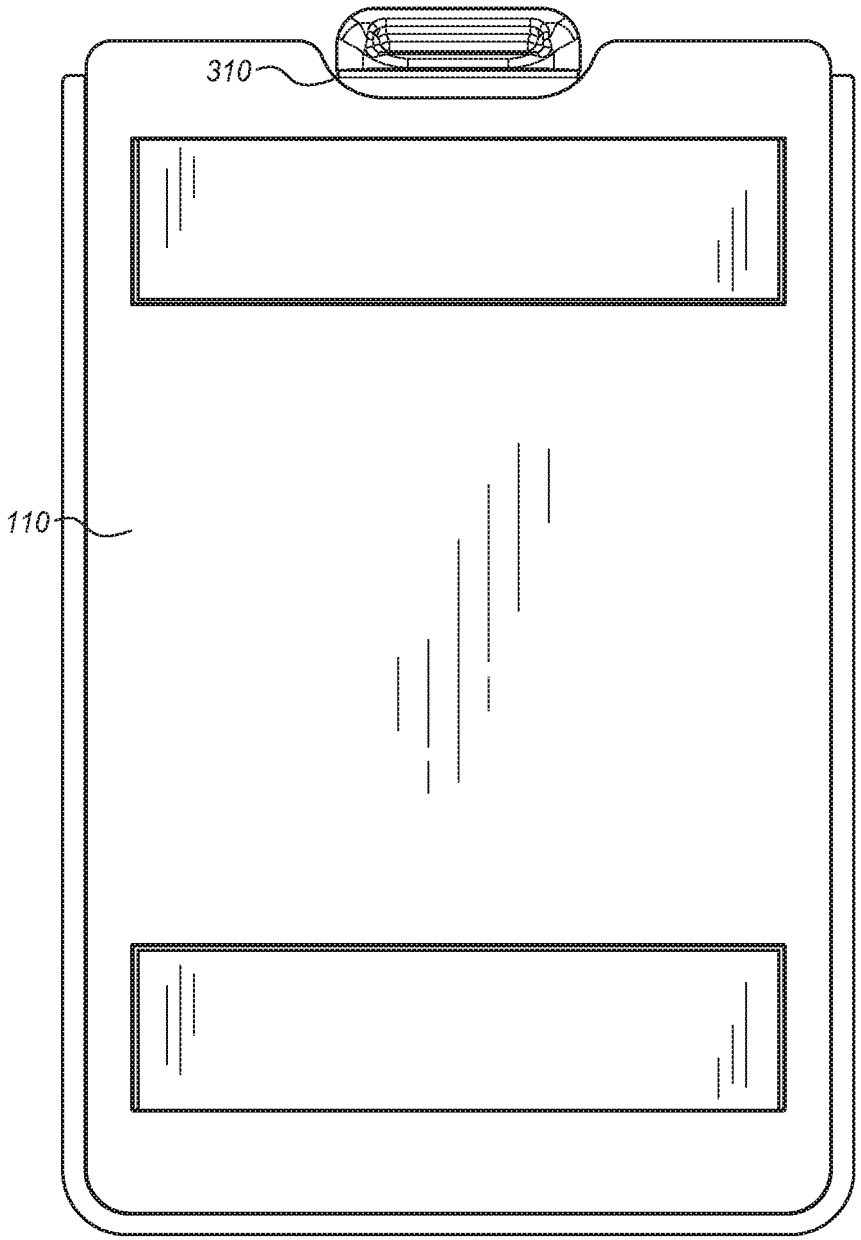
FIG. 3 shows a front view of the device mounted card holder and wallet of FIG. 1.
Figure 4:
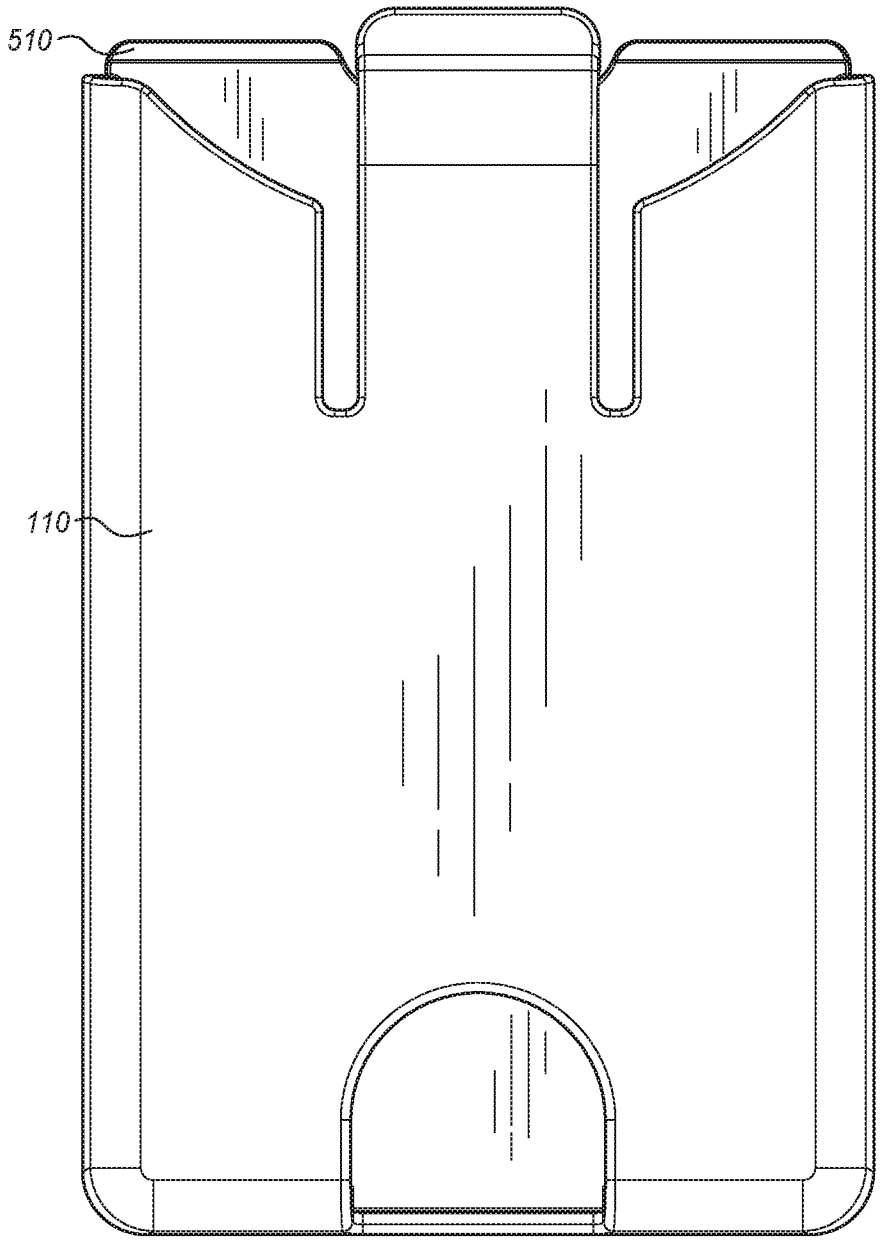
FIG. 4 shows a rear view of the device mounted card holder and wallet of FIG. 1.

FIG. 2 shows the opposite side view of the device mounted holder 100 of FIG. 1. Here, arm 210 is clearly visible. Arm 210 terminates in clip end 140. Arm 210 is generally defined by two cuts 220 in body 110. In use, when arm 210 is flexed by pushing on clip end 140, the arm 210 flexes along the length of the arm, from approximately area 240 to area 245. Area 245 is where arm 210 joins with body 110. Additionally, visible in this view is holding lip 250 that serves to hold cards in place until clip end 140 is flexed away. Aperture 260 provides an opening through which a user may advance cards out of the slot so that the user may remove them. In many configurations, device mounted holder 100 may be made out of essentially two pieces of material, back portion 270 and front and side portion 280. These portions may be joined at area 290 and around the entirety of the device. Numerous other constructions are possible, however, the generally the design, in many embodiments, include a slot and a clip end which may be flexed away from the slot opening in order to release cards in the slot. Also, the body 110 is cut away near the opening of the slot, such that a user may grab cards in the slot in order to pull them out.

Figure 5:
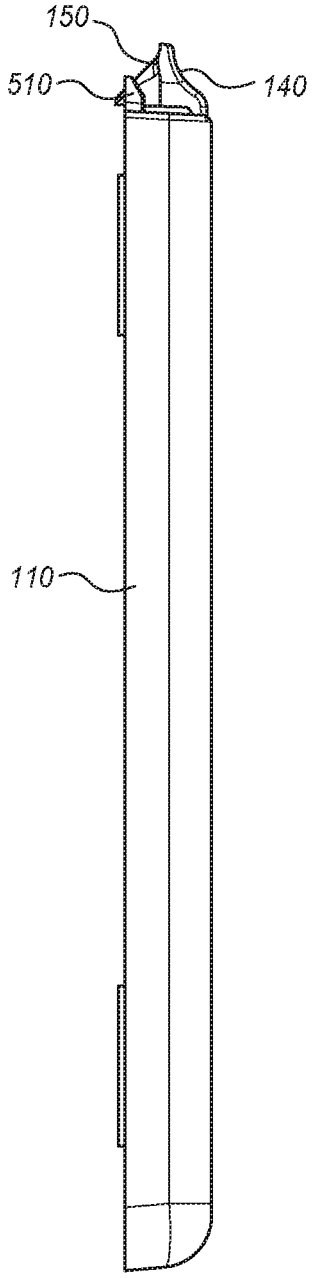
FIG. 5 shows a left-side view of the device mounted card holder and wallet of FIG. 1.
Figure 6:
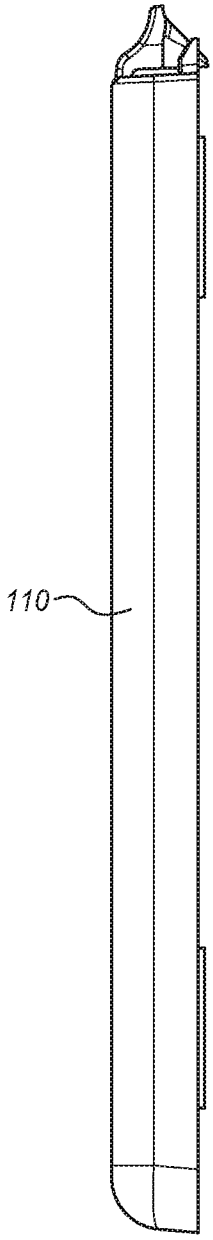
FIG. 6 shows a right-side view of the device mounted card holder and wallet of FIG. 1.
Figure 7:
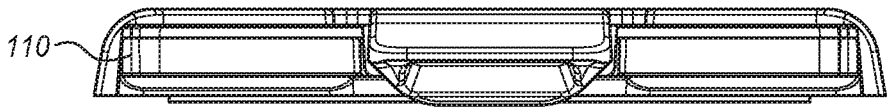
FIG. 7 shows a top view of the device mounted card holder and wallet of FIG. 1.
Figure 8:
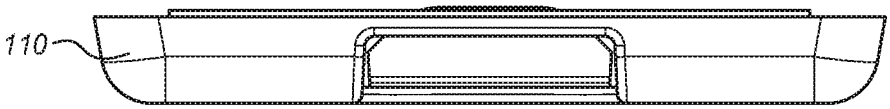
FIG. 8 shows a bottom view of the device mounted card holder and wallet of FIG. 1.

FIGS. 3-8 show additional views of device mounted holder 100. As is clear in FIG. 3, the body 110 also includes a cut away 310, such that clip end 140 may sit in the cut away 310 and may be accessed by the user. FIG. 5 shows a side view of the device mounted holder 100 that show how the device is configured for the optimal insertion of cards. Ramped portion 150 and lip 510 cooperate to allow for the optimal and easy insertion of cards. In operation, a card pressed into ramped portion 150 slides up the ramp towards lip 510 until contacting lip 510. Lip 510 is also visible in FIG. 4. Lip 510 prevents the card from sliding further and therefore the application of additional pressure results in clip end 140 being flexed away from lip 510, such that the card may be inserted. In many configurations, the lip is also ramped in the opposite direction as the ramped portion 150. This helps ensure that the cards inserted push away the clip end for easy insertion. The lip 510 and the ramped portion 150 form a V-shape when viewed from the side, however, may not actually intersect.

Numerous alternatives are possible for body shapes and sizes for device mounted holder 100. Additionally, numerous interconnection possibilities may be used to attach device mounted holder 100 to a smartphone or other device, beyond the adhesive strips provided, including Velcro, magnets, or other mechanical interconnection techniques. Device mounted holder 100 may be integrated into the body of a case or other mobile phone accessory, and in such a scenario, the adhesive or other attachment mechanism may be omitted. In many scenarios, the arm flexes. Optionally, a living hinge may be integrated into the device where the arm meets the body portion. In such a scenario, the arm may not flex, or the arm may flex less and the living hinge may be the primary flection point.

Generally, the device mounted holder may also include an internal spring, located in the slot, that may press against cards in the slot in order to hold them flush. Additionally, the device is generally created to hold a few cards, but may be designed to hold one to twenty or even more cards. When the term cards is used it is typically referring to the standard size credit cards and identification cards having a size of three and three eights by 2 and one eight inches.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A mobile device mounted holder, comprising:

a body portion, the body portion including a slot for receiving cards and a lip;

an attachment mechanism, integrated with the body portion, for attaching to a mobile device; and a clip end including a ramped portion and located proximate to the slot, such that the clip end prevents the cards, when located in the slot, from sliding out of the slot and the clip end is attached to a flexible arm such that the clip end has a flexed position and in the flexed position the cards are removable, wherein the lip is ramped in a direction opposite the ramped portion such that the lip and the ramped portion form a V-shape.

2. The mobile device mounted holder of claim 1, wherein the arm is formed by a first and second break in the body portion.

3. The mobile device mounted holder of claim 1, wherein the lip and the ramped portion cooperate to direct a card edge pressed against the ramped portion to an intersection point and at the intersection point the card edge will push against the ramped portion, causing the clip end to flex away from the lip and allow the insertion of the card edge.

4. The mobile device mounted holder of claim 1, wherein the slot is sized to receive a standard credit card.

5. The mobile device mounted holder of claim 4, wherein the body portion includes an aperture located distal from the clip end allowing access to the cards located in the slot.

6. The mobile device mounted holder of claim 5, wherein the attachment mechanism is adhesive.

7. The mobile device mounted holder 5, wherein the attachment mechanism is a case.

8. The mobile device mounted holder of claim 5, wherein the clip end includes a depression for receiving a finger of a user.

9. The mobile device mounted holder of claim 8, wherein the arm flexes along a length of the arm when the clip end is in the flexed position, the length of the arm stretching from the clip end to an interconnection point of the arm and the body portion.

10. The mobile device mounted holder of claim 9, wherein the body portion includes a cutaway portion proximate to the clip end, providing access to the cards in the slot.

11. The mobile device mounted holder of claim 10, wherein the clip end and the attachment mechanism are on opposite sides of the body portion.

12. The mobile device mounted holder of claim 11, wherein the body portion is formed of a first body piece and a second body piece.

13. The mobile device mounted holder of claim 12, wherein the first body piece is a plate on which the attachment mechanism is attached.

14. The mobile device mounted holder of claim 13, wherein the second body piece is a plate with three edges extending perpendicularly from the plate and the second body piece includes the arm.

15. A mobile device mounted holder, comprising:

a body portion, the body portion including a slot for receiving cards;

an attachment mechanism, integrated with the body portion, for attaching to a mobile device; and a clip end located proximate to the slot, such that the clip end prevents the cards, when located in the slot, from sliding out of the slot and the clip end is attached to a flexible arm such that the clip end has a flexed position and in the flexed position the cards are removable;

wherein the clip end includes a ramped portion, the body portion includes a lip, the lip and the ramped portion cooperate to direct a card edge pressed against the ramped portion to an intersection point and at the intersection point the card edge will push against the ramped portion, causing the clip end to flex away from the lip and allow the insertion of the card edge, and wherein the lip is ramped in a direction opposite the ramped portion such that the lip and the ramped portion form a V-shape.

16. The mobile device mounted holder of claim 15, wherein the body portion includes an aperture located distal from the clip end allowing access to the cards located in the slot.

17. The mobile device mounted holder of claim 15, wherein the clip end includes a depression for receiving a finger of a user.

18. The mobile device mounted holder of claim 15, wherein the arm flexes along a length of the arm when the clip end is in the flexed position, the length of the arm stretching from the clip end to an interconnection point of the arm and the body portion.

19. The mobile device mounted holder of claim 15, wherein the body portion includes a cutaway portion proximate to the clip end, providing access to the cards in the slot.

20. A method of using a mobile device mounted holder, comprising:

providing a mobile device mounted holder including:

a body portion, the body portion including a slot for receiving cards;

an attachment mechanism, integrated with the body portion, for attaching to a mobile device; and a clip end located proximate to the slot, such that the clip end prevents the cards, when located in the slot, from sliding out of the slot and the clip end is attached to a flexible arm such that the clip end has a flexed position and in the flexed position the cards are removable;

wherein the clip end includes a ramped portion, the body portion includes a lip, wherein the lip is ramped in a direction opposite the ramped portion such that the lip and the ramped portion form a V-shape;

attaching the mobile device mounted holder to a mobile device using the attachment mechanism; and inserting a card by pressing the card into the ramped portion and the lip such that the lip and the ramped portion cooperate to direct the card to an intersection point and flex the clip end away from the lip and allow the insertion of the card.

21. The method of claim 20, further comprising:

pressing the clip end away from the lip; and removing the card.

* * * * *